United States Patent [19]

Klopfenstein

[11] 4,189,151

[45] Feb. 19, 1980

[54] CUBE PUZZLE

[76] Inventor: Fred H. Klopfenstein, 15402 Mottley Dr., La Mirada, Calif. 90638

[21] Appl. No.: 953,360

[22] Filed: Oct. 23, 1978

[51] Int. Cl.[2] ..... A63F 9/08

[52] U.S. Cl. ..... 273/156

[58] Field of Search ..... 273/156, 157 R

[56] References Cited

FOREIGN PATENT DOCUMENTS 283666 1/1928 United Kingdom ..... 273/156

308886 4/1929 United Kingdom ..... 273/156

OTHER PUBLICATIONS

"Martin Gardner's New Mathematical Diversions from Scientific American," Simon & Schuster, New York, 1966, pp. 184–195.

*Primary Examiner*—Anton O. Oechsle

*Attorney, Agent, or Firm*—Edgar W. Averill, Jr.

[57] ABSTRACT

An educational cube puzzle game comprising sixteen cubes, eight of one color combination and eight of a second color combination. The first set of cubes has a first arrangement of colors having six different colors, one on each face. The second set of eight cubes also has a different color on each face and also contains the same six colors but the arrangement of the colors is different from the first set of cubes.

1 Claim, 5 Drawing Figures

FIG. 1.
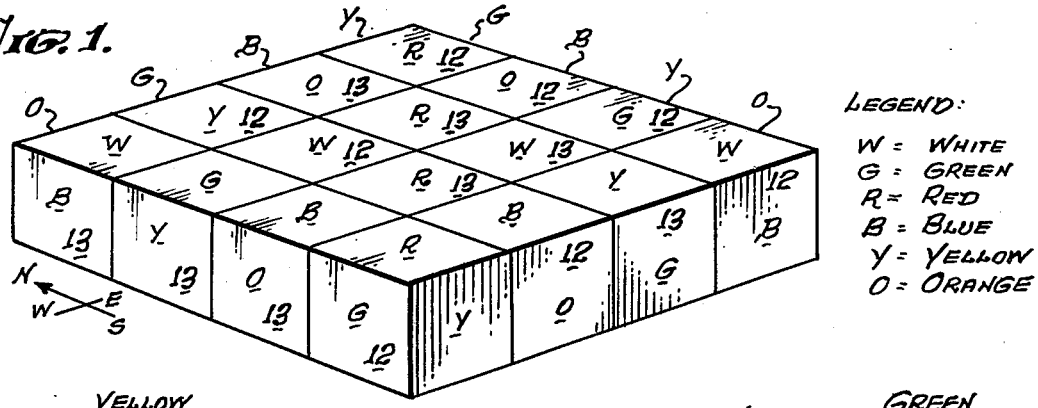
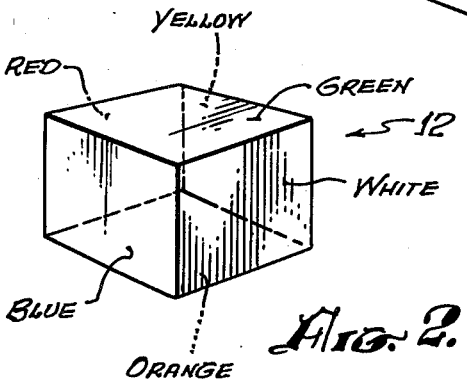
FIG. 2.
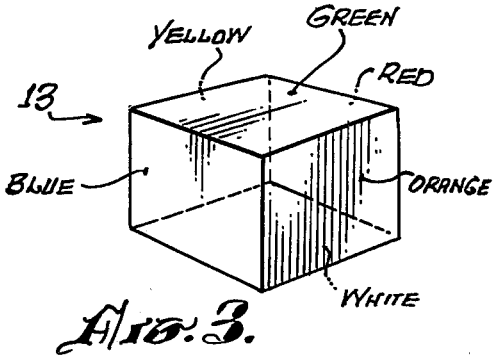
FIG. 3.
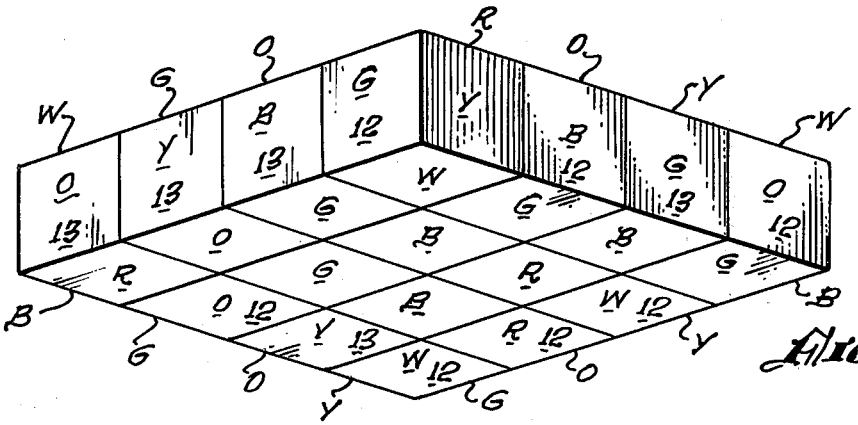
FIG. 4.
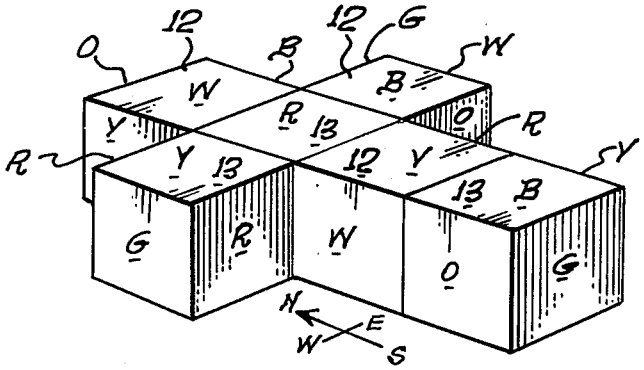
FIG. 5.

CUBE PUZZLE

BACKGROUND OF THE DISCLOSURE

The field of the invention is puzzles or games and the invention relates more specifically to games which utilize sets of colored cubes.

Over the years, numerous games have been developed which utilize blocks or cubes having different colors. The object of the game is to arrange the colors in some desired orientation. One such game which was popular some years ago was called "Instant Insanity." As the name implies, this puzzle was very difficult to solve and the users often became frustrated by their inability to arrive at the correct solution. Another cube puzzle is disclosed in the U.S. Pat. No. 3,788,645. Unlike "Instant Insanity" each cube face has more than one color and the object of the game is to arrange the cubes so that adjacent cubes define a particular arrangement or combination of colors on the surface of the combined cubes. Another color association game is disclosed in U.S. Pat. No. 3,690,671 where colored panels are used. A game utilizing hexagonal blocks is disclosed in U.S. Pat. No. 2,247,250 and U.S. Pat. Nos. 854,547 and 487,798 utilize cards or tablets also having indicia or colors on the face thereof. Cubes having the markings of the suits in a deck of playing cards are shown in U.S. Pat. No. 2,024,541.

The essence of a successful puzzle is to arrive at a degree of difficulty which neither frustrates the user by being too difficult nor bores the user by being too easy to solve. Another shortcoming of several of the prior art puzzles is the difficulty in manufacturing the finished product. This is particularly true where there are numerous different colors on the same face of each cube such as shown in U.S. Pat. No. 3,788,645.

SUMMARY OF THE INVENTION

The present invention is for an educational color association puzzle comprising a plurality of cubes of equal size. The cubes may be arranged to form a square wherein no two colors are repeated in any six adjacent surfaces either horizontally or vertically.

BRIEF DESCRIPTION OF THE DRAWINGS

FIG. 1 is a perspective view of sixteen cubes of the present invention arranged in a square.

FIG. 2 is a perspective view of one of the two types of cubes of the present invention.

FIG. 3 is a perspective view of the other of the two types of cubes of the present invention.

FIG. 4 is a perspective view of the underside of the cubes of FIG. 1.

FIG. 5 is an alternate arrangement of six cubes of the present invention.

DESCRIPTION OF THE PREFERRED EMBODIMENTS

The object of the puzzle of the present invention is to arrange sixteen cubes in a manner so that there are no two colors along any line or row which are the same. For purposes of discussion, the directions of the cubes in FIG. 1 will be indicated by North, South, East and West as shown in the left of FIG. 1.

The colors are indicated by the first letter of the color as follows: Y=yellow, R=red, B=blue, G=green, W=white and O=orange. For instance if one follows the westerly row of colors from south to north, the colors would read yellow, red, blue, green, white and orange. The next row in an easterly direction again reading north, is arranged in the order of orange, blue, red, white, yellow and green. The next most easterly row is green, yellow, white, red, orange and blue. The furtherest easterly row is blue, white, green, orange, red and yellow. Next reading in easterly direction, beginning with the southern most row, the colors are green, red, blue, yellow, white and orange. The second row again reading easterly is orange, blue, red, white, green and yellow. The next row is yellow, green, white, red, orange and blue and the northern most row is blue, white, yellow, orange, red and green. In addition to being a different color along the rows comprising two sides and four surfaces, the four surfaces on each side are also different from each other. For instance, the southernmost sides read yellow, orange, green and blue. The easternmost sides are orange, yellow, blue and green. The northernmost sides are yellow, blue, green and orange and the westernmost sides are blue, yellow, orange and green.

The above described colors shown in FIG. 1 represent but one of the configurations that can be obtained with the two color combinations of blocks shown in FIGS. 2 and 3. The arrangement of FIG. 1 contains eight of the blocks of FIG. 2 and eight of the blocks of FIG. 3. The blocks of FIG. 2 are indicated by reference character 12 and the blocks of FIG. 3 are marked with reference character 13. The color configuration shown in FIG. 2 indicated that each face of cube 12 has a different colored surface. The underside of the combination of blocks of FIG. 1 is shown in FIG. 4. It can be seen that there are repetive colors on the underside of this configuration and one need only satisfy the color differences along the sides and top to complete the puzzle.

In addition to the square configuration of FIGS. 1 and 4 a smaller number of blocks may also be arranged to yield different colors running along each of the sides and over the combination of top and sides. For instance, in FIG. 5, again using the north, south, east and west directions indicated all colors are different in a northerly direction along the four block portion of the cross namely green, blue, yellow, red, white and orange. Along the shorter length of the cross in an easterly direction the colors are green, yellow, red, blue and white; reading along the west side, in a northerly direction, the colors are orange, white, red, green, blue and yellow. Lastly, reading in a northerly direction, but this time along the eastern surface, the colors are yellow, red, orange, white, green, and blue.

The resulting puzzle may be solved in other configurations than those shown in FIGS. 1 and 5. The degree of difficulty is such that the game is not frustrating because of the availability of different solutions other than those shown.

Another advantage of the present invention is the ease of manufacture of the blocks. The blocks may be formed of any material of construction such as wood or plastic. For example, all blocks of the type shown in FIG. 2 may be placed together and one surface of all blocks is painted as by spray painting a single color. After this surface is dry, the blocks are all reversed and the opposite side is painted a different color. After drying all blocks are turned one turn in the same direction and the procedure is continued until all six surfaces have been painted. The same procedure is carried out for the second block type. The game or puzzle is then assembled by placing eight blocks of each type in a package. Instructions may also be provided to show possible correct solutions if desired. In place of colors, other indicia such as circles, crosses, stars and the like may be used.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

I claim:

1. An educational color association puzzle comprising a plurality of cubes of equal size, said cubes being of two types of color configurations, the first type having a single first arrangement of six different colors, each face of the first type having a different color, and the second type having a single different arrangement of the same six colors, each face of said second type also having a different color, there being at least eight of each of said types.

* * * * *